US005975950A

United States Patent [19]

Yamaguchi

[11] Patent Number: 5,975,950

[45] Date of Patent: Nov. 2, 1999

[54] SHIELDING CONNECTOR

[75] Inventor: Noboru Yamaguchi, Shizuoka, Japan

[73] Assignee: Yazaki Corporation, Tokyo, Japan

[21] Appl. No.: 09/085,172

[22] Filed: May 28, 1998

[30] Foreign Application Priority Data

May 29, 1997 [JP] Japan ..... 9-140237

[51] Int. Cl.[6] ..... H01R 9/05

[52] U.S. Cl. ..... 439/585; 439/610

[58] Field of Search ..... 439/585, 610, 439/581, 394

[56] References Cited

U.S. PATENT DOCUMENTS 5,145,409 9/1992 Sato ..... 439/585

FOREIGN PATENT DOCUMENTS 2515586 8/1996 Japan .
2577272 11/1996 Japan .

*Primary Examiner*—Neil Abrams
*Assistant Examiner*—Javaid Nasri
*Attorney, Agent, or Firm*—Armstrong, Westerman, Hattori, McLeland & Naughton

[57] ABSTRACT

A shielding connector is provided. This shielding connector comprises: an inner terminal connected to the inner conductor of a shielded cable; an insulating holding member for holding the inner terminal; an outer terminal 16 connected to the outer conductor of the shielded cable; a shielding terminal made up of the inner terminal, the insulating holding member, and the outer terminal; and an insulating housing for accommodating the shielding terminal. The outer terminal is in contact with a shielding layer in the insulating housing. The insulating holding member is provided with a contact holding cylinder at one end of the insulating support plate. The contact holding cylinder has a locking arm to be engaged with the inner terminal for preventing it from slipping off backward. The outer terminal is provided with a holding member receiving portion at one end of a conductive substrate and an outer conductor connecting portion at the other end of the conductive substrate which is behind the inner conductor connecting portion.

7 Claims, 8 Drawing Sheets

SHIELDING CONNECTOR

BACKGROUND OF THE INVENTION

1. Field of the Invention

The present invention relates to a shielding connector for connecting signal wires, and more particularly to an improved securing structure for connecting an inner terminal for wire connection and an outer terminal for outer conductor connection.

2. Related Art

FIGS. 6 to 8 show a conventional shielding connector (disclosed in the specification of Japanese Patent No. 2577272).

In these drawings, a shielding terminal is indicated by 61, and received by an insulating housing (not shown). The shielding terminal 61 is made up of a pair of inner terminals 62 connected to the core portion 80*a* of a shielded cable 80, an insulating terminal holding member 63 for holding the inner terminals 62, and an outer terminal connected to the outer conductor 80*b* of the shielded cable 80.

The terminal holding member 63 has terminal insertion holes 63*a* leading to both side surfaces. Punch insertion concaves 63*b* are formed directly above the terminal insertion holes 63*a*. The inner terminals 62 are secured to the terminal holding member in the following manner. As shown in FIG. 8A, the terminal main body 62*b* having a hole 62*a* is inserted into the terminal insertion holes 63*a* of the terminal holding member 63, so that the positions of the hole 62*a* and the punch insertion concaves 63*b* are adjusted to each other. The terminal holding member 63 is then pressed by a punch P, as shown in FIG. 8B, to plunge a part of the terminal holding member 63 in the hole 62*a* to form a plunge portion 63*c*, where the securing of the inner terminal 62 to the terminal holding member 63 is conducted.

Japanese Utility Model No. 2515586 discloses a structure shown in FIGS. 9A and 9B as a technique for preventing the outer conductor of a shielded cable from coming into contact with a terminal.

As shown in FIG. 9A, an opening 65*a* is formed through the side wall in the vicinity of the inset edge of a terminal 62' of an insulating housing 65. A mallet 66 which opens and closes the opening 65*a* is connected to the insulating housing 65 via a long band 67. The mallet 66 is provided with a pair of holding members 68. When the opening 65*a* is closed by the mallet 66, an exposed outer conductor 80*c* of the shielded cable 80 is held between a placement member 69 inside a terminal receiving chamber 65*b* and the holding members 68. A stopper 70 is provided to prevent the terminal 62' from slipping off backward.

With the above prior art, however, inserting the inner terminal 62 into the terminal holding member 63 is not enough adjust the positions. Therefore, an additional process of adjusting the hole 62*a* to the punch insertion concaves 63*b* is necessary, as well as the punch securing process. Furthermore, the jigs such as the punch P and a driving mechanism provided with such jigs result in a dramatic increase of the production costs.

In order to prevent contact between the outer conductor 80*c* and the terminal 62', the insulating housing 65 is provided with the movable mallet 66 having the opening 65*a* and the holding members 68. This makes the structure of the insulating housing 65 more complicated. There is another drawback that the hole formed on the housing reduces shielding effects.

SUMMARY OF THE INVENTION

An object of the present invention is to provide a shielding connector having a simpler structure which requires no jigs for positioning an inner terminal and an insulating holding member for holding the inner terminal.

Another object of the present invention is to provide a shielding connector which can surely prevent leak between the inner conductor connected to the inner terminal and the outer conductor connected to the outer terminal so that high shielding effects can be obtained.

Yet another object of the present invention is to provide a shielding connector having a simpler structure including a shielding terminal and an insulating housing therefor.

In accordance with a first aspect of the present invention, a shielding connector includes: an inner terminal including a conductive substrate, an electrical contact at a first end of the conductive substrate, and an inner conductor connecting portion at a second end of the conductive substrate, the inner terminal being connected to the inner conductor of a shielded cable; an insulating holding member holding the inner terminal; an outer terminal covered with the insulating holding member and connected to the outer conductor of the shielded cable; a shielding terminal made up of the inner terminal, the insulating holding member, and the outer terminal; an insulating housing for accommodating the shielding terminal and having a shielding layer in contact with the outer terminal; a contact holding cylinder for receiving the electrical contact of the inner terminal at a first end of an insulating support plate; a locking arm to be engaged with the inner terminal in the contact holding cylinder so as to prevent the inner terminal from slipping off backward; a holding member receiving portion for receiving and securing the contact holding cylinder of the insulating holding member at the first end of the conductive substrate; and an outer conductor connecting portion behind the inner conductor connecting portion of the insulating holding member at the second end of the conductive substrate. In this shielding connector, the insulating holding member includes the contact holding cylinder and the locking arm, and the outer terminal includes the holding member receiving portion and the outer conductor connecting portion.

According to the first aspect of the present invention, the electrical contact of the inner terminal is inserted into the contact holding cylinder of the insulating holding member, and engaged with the locking arm, thereby completing the attachment between them. Thus, complicated additional processes such as positioning of the inner terminal and securing by a punch are no longer necessary.

The outer terminal and the insulating holding member holding the inner terminal can also be easily connected to each other simply by inserting the contact holding cylinder of the insulating holding member into the holding member receiving portion of the outer terminal.

In accordance with a second aspect of the present invention, the inner conductor connecting portion of the inner terminal is made up of a pair of side walls standing from both sides of the second end of the conductive substrate, and a pair of inner conductor holding pieces formed by bending inward the front free edge of the pair of side walls on the side of the electrical contact, and a pair of inner conductor coat holding pieces formed by bending inward the rear free edge of the pair of side walls facing to each other. Between the back and front inner conductor holding pieces and the inner conductor coat holding pieces, an inner conductor slack space is formed.

According to the second aspect of the present invention, the inner conductor is sandwiched by the front and back inner conductor holding pieces, and thus connected to the inner terminal. In such condition, the danger of a cutoff is reduced, and the following inner conductor cover is held in an S-shape in the inner conductor slack space. The inner conductor coat is held and secured by the pair of inner conductor cover holding pieces. Even if a pull strength acts on the shielded cable, the force is reduced by the inner conductor coat holding pieces and the inner conductor slack space, without adversely affecting the inner conductor. Thus, a stable electrical connected condition can be maintained.

In accordance with a third aspect of the present invention, the insulating holding member is provided with insulating separating ribs on both sides of a second end of the insulating support plate, and the inner conductor connecting portion of the inner terminal is separated from the outer conductor connecting portion of the outer terminal by means of the insulating separating ribs. Thus, there is no risk of leak between the inner conductor connected to the inner terminal and the outer conductor connected to the outer terminal.

In accordance with a fourth aspect of the present invention, the insulating holding member includes a stopper concave portion on the bottom surface of the insulating support plate, and the outer terminal is provided with a stopper protrusion on the upper surface of the conductive substrate, and the stopper protrusion is engaged with the stopper concave portion so as to secure the insulating holding member and the outer terminal.

In accordance with a fifth aspect of the present invention, the insulating housing is provided with a retainer detachably mounted to the rear opening edge of a terminal receiving chamber which accommodates the shielding terminal, and the retainer prevents the shielding terminal from slipping off backward. Thus, the shielding terminal can be doubly prevented from slipping off backward by the stopper means inside the terminal receiving chamber and the retainer.

The above and other objects and features of the present invention will be more apparent from the following description taken in conjunction with the accompanying drawings.

BRIEF DESCRITION OF THE DRAWINGS

DETAILED DESCRIPTION OF THE PREFERRED EMBODIMENTS

The following is a description of one embodiment of the present invention, with reference to the accompanying drawings.

Figure 1:
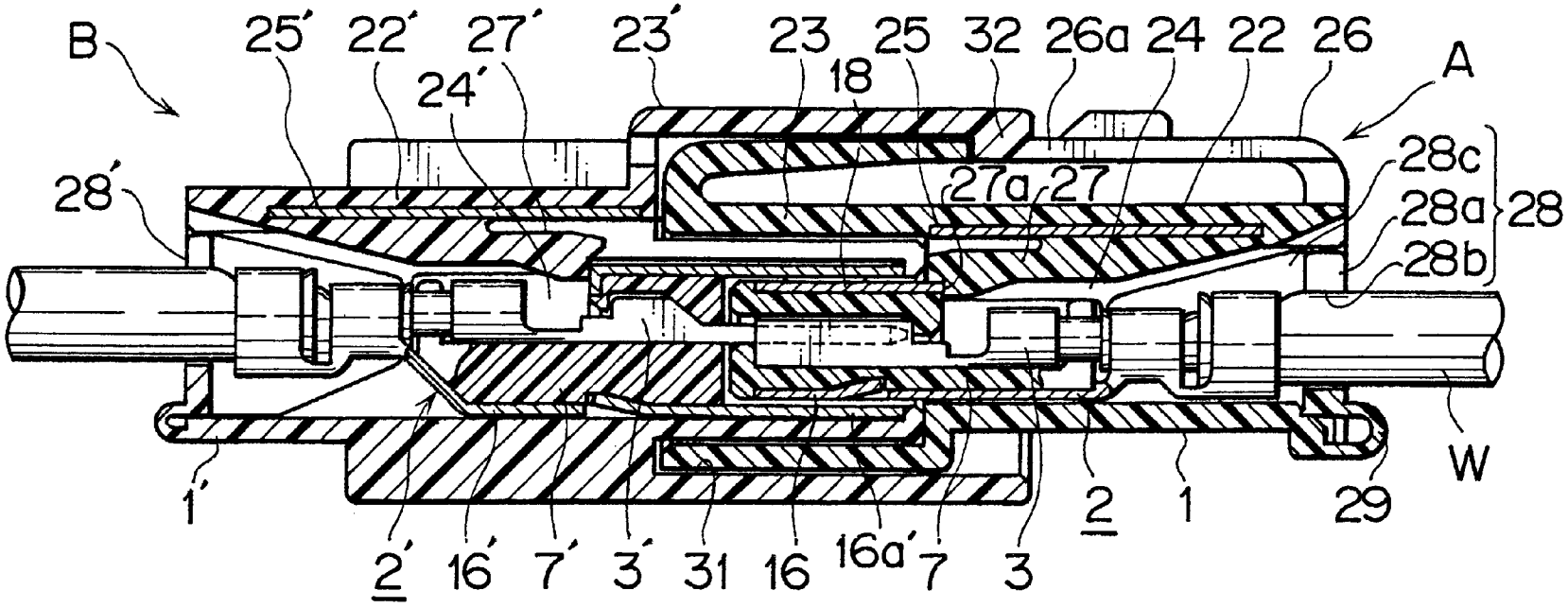
FIG. 1 is a vertical sectional view illustrating a male shielding connector engaged with a female shielding connector of a first embodiment of the present invention.
Figure 2:
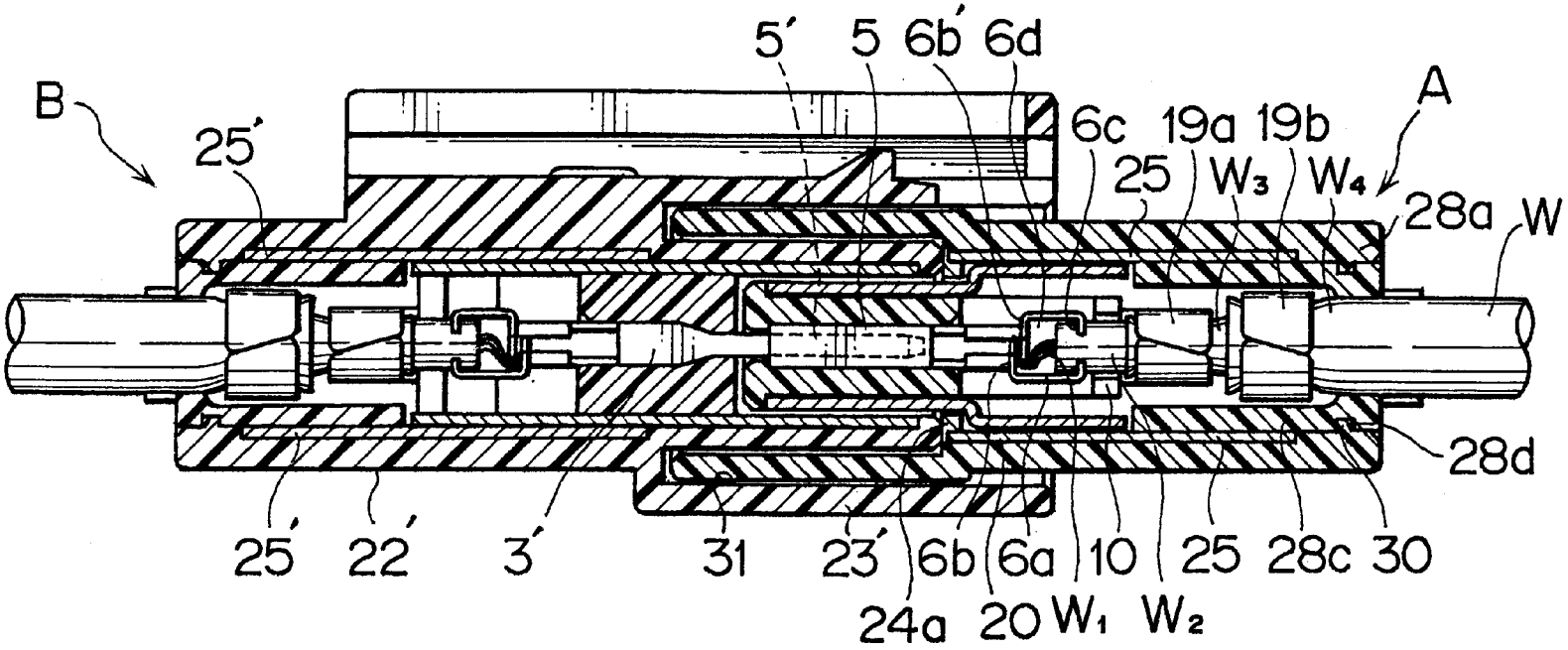
FIG. 2 is a transverse sectional view of FIG. 1.
Figure 3:
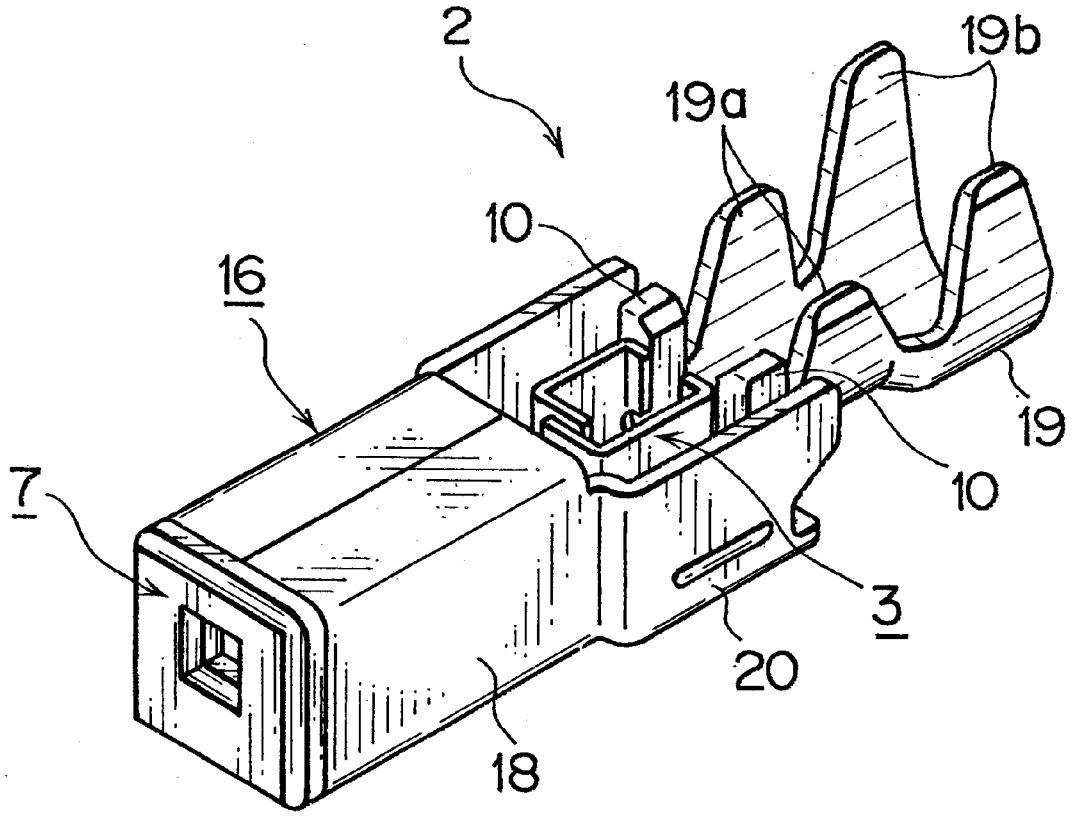
FIG. 3 is a schematic perspective view of the shielding terminal of FIG. 1.
Figure 4:
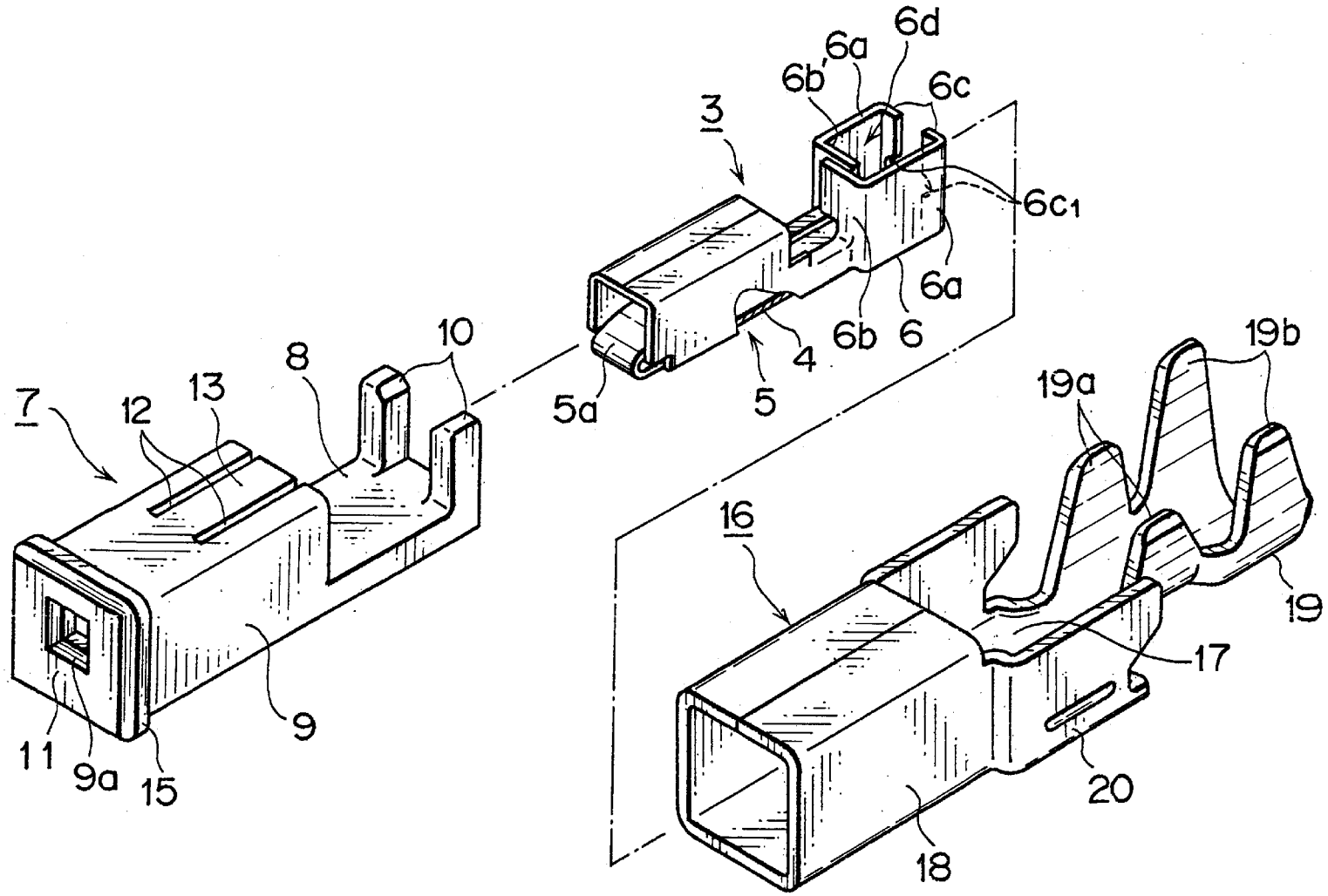
FIG. 4 is an exploded perspective view of the shielding terminal of FIG. 3.

In FIGS. 1 and 2, a male shielding connector is indicated by A, and a female shielding connector is indicated by B. The male shielding connector A is made up of a male-type insulating housing 1 made of a synthetic resin, and a female-type shielding terminal 2 accommodated by the insulating housing 1. Likewise, the female shielding connector B is made up of a female-type insulating housing 1' and a male-type shielding terminal 2'.

In the male shielding connector A, the female-type shielding terminal 2 comprises a female-type inner terminal 3 connected to the inner conductor $W_1$ of an outer conductor (see FIGS. 1 and 2), an insulating holding member 7 for holding the inner terminal 3, and a female-type outer terminal 16 covered with the insulating holding member 7 and connected to an outer conductor $W_3$.

In other words, the shielding terminal 2 is made up of a signal wire terminal (the inner terminal 3), an outer conductor terminal (the outer terminal 16), and the insulating holding member 7 situated between the signal wire terminal and the outer conductor terminal.

The female-type inner terminal 3 is provided with an electrical contact 5 at a first end of a conductive substrate 4, and an inner conductor connecting portion 6 for the shielded cable W at the second end of the conductive substrate 4.

The electrical contact 5 is formed as a cylindrical tab receiving portion for receiving the tab-like electrical contact of the shielding terminal 2', which is the mating terminal. The electrical contact 5 is provided with an elastic tongue 5*a* extending from the top edge of the conductive substrate 4 and bending toward the inside of the tab receiving portion.

The inner conductor connecting portion 6 is made up of a pair of side walls 6*a* standing unitarily from both sides of the second end of the conductive substrate 4, a pair of inner conductor holding members 6*b* and 6*b'* formed by bending inward the forward free edges of the side walls 6*a*, and a pair of inner conductor coat holding members 6*c* formed by bending inward the rearward free edges of the side walls 6*a*.

The pair of inner conductor holding members 6*b* and 6*b'* have such length that they are overlapped on each other to sandwich the inner conductor $W_1$ of the shielded cable W. The pair of inner conductor coat holding members 6*c* are provided with semi-circular coat holding grooves $6c_1$ for accommodating the inner conductor coat $W_2$ of the shielded cable W. The inner conductor holding members 6*b* and 6*b'* and the inner conductor coat holding members 6*c* stands at predetermined intervals. In between, a box-like inner conductor slack space 6*d* is formed.

The insulating holding member 7 is made of a synthetic resin and provided with a box-like contact holding cylinder 9 on the front half of the insulating support plate 8, and with a pair of insulating separating ribs 10 at both sides of the rear end. The distance between the insulating separating ribs 10 and the contact holding cylinder 9 is set such that when inserted into the holding cylinder 9 in a predetermined way, the electrical contact 5 is situated behind the inner conductor connecting portion 6.

The contact holding cylinder 9 has a contact receiving opening 9*a* therein so that both ends are open. A stopper wall 11 (shown in FIG. 5) for preventing the electrical contact 5 from slipping off forward is formed at the front end of the contact holding cylinder 9. A cantilevered locking arm 13 is formed with two slits 12 at the rear end of the upper wall of the contact holding cylinder 9. The locking arm 13 for preventing the electrical contact 5 from slipping off rearward is provided with a stopper protrusion 13*a* on the inner surface of the rear end. A stopper concave portion 14 is formed on the bottom surface of the insulating support plate 8, and a detent flange 15 is provided on the outer surface of the front edge of the contact holding cylinder 9.

The outer terminal 16 is large enough to accommodate the insulating holding member 7. In other words, the outer terminal 16 is provided with a box-like holding member receiving portion 18 having openings at both ends thereof. The holding member receiving portion 18 is situated at one end of the conductive substrate 17, while an outer conductor connecting portion 19 is provided at the other end. The contact holding cylinder 9 of the insulating holding member 7 is received by the holding member receiving portion 18. Here, the outer conductor connecting portion 19 is situated behind the insulating separating ribs 10 at the rear end of the insulating holding member 7. Between the holding member receiving portion 18 and the outer conductor connecting portion 19 is formed an expanding portion 20 having a width greater than the holding member receiving portion 18, so that the inner conductor connecting portion 6 of the inner terminal 3 and the insulating separating ribs 10 of the insulating holding member 7 can be accommodated.

The outer conductor connecting portion 19 is made up of a pair of U-shaped outer conductor holding pieces 19*a* standing on both sides of the conductive substrate 17, and a pair of U-shaped outer coat holding pieces 19*b*. The conductive substrate 17 is provided with a stopper 21 (shown in FIG. 5) to be engaged with the stopper concave portion 14 inside the holding member receiving portion 18.

The distance between the outer conductor holding pieces 19*a* (the outer coat holding pieces 21) of the outer conductor connecting portion 19 is longer than the width of the inner conductor connecting portion 6 of the inner terminal 3, so that the inner conductor coat $W_2$ of the shielded cable W can be inserted with ease.

Referring back to FIGS. 1 and 2, the insulating housing 1 is provided with a hood 23 on the front of a housing main body 22. A terminal receiving chamber 24 for receiving the rear half of the shielding terminal 2 is formed inside the housing main body 22. A shielding plate 25 as a shielding layer is formed by molding unitarily on the four (top, bottom, and two sides) inner surfaces of the terminal receiving chamber 24. Instead of the shielding plate 25, a shielding layer such as a copper plating layer may be formed on the inner wall of the terminal receiving chamber 24 by electroless plating.

A locking arm 26 supported at both ends and having a stopper hole 26*a* extending from the hood 23 to the housing main body 22 is formed on the upper portion of the outer wall of the insulating housing 1.

The terminal receiving chamber 24 is provided with a flexible stopper arm 27 to be engaged with the shielding terminal 2 on its upper wall. A retainer 28 for the shielding terminal 2 is releasably attached to the opening at the rear end of the terminal receiving chamber 24.

The flexible stopper arm 27 extends forward from the rear end of the upper wall, with the top edge reaching the boundary between the housing maim body 22 and the hood 23. A stopper protrusion 27*a* is formed at the top edge. The retainer 28 is connected to the housing main body 22 via a hinge 29. The retainer 28 is made up of a back plate 28*a* forming a U-shaped wire insertion groove 28*b*, and a pair of terminal pressing plates 28*c* extending forward from both sides of the back plate 28*a*. A stopper groove 28*d* to be engaged with a stopper protrusion 30 on the inner surface of the terminal receiving chamber 24 is formed at the base portion of the terminal holding plate 28*c*.

Meanwhile, like the male shielding connector A, the terminal shielding connector B accommodates a female-type shielding terminal 2' inside the insulating housing 1'. The differences between the male shielding connector A and the female shielding connector B are as follows.

First, an electrical contact 5' of a male-type inner terminal 3' which constitutes the male-type shielding terminal 2' takes a tab-like form in conformity with the electrical contact 5 of the female-type inner terminal 3.

Secondly, an outer terminal 16' which constitutes the male-type shielding terminal 2' has a pipe 16*a'* in the front for receiving the box-like holding member receiving portion 18 of the female-type outer terminal 16.

Thirdly, the female-type insulating housing 1' is provided with a double structure shell 23' having an engagement groove 31 corresponding to the hood 23 of the male-type insulating housing 1 in the front of the housing main body 22'.

Fourthly, a stopper protrusion 32 to be engaged with the stopper hole 26*a* of the locking arm 26 of the male-type insulating housing 1 is formed on the upper outer wall of the female-type insulating housing 1'.

Other components, such as an insulating holding member 7', a flexible stopper arm 27' inside a terminal receiving chamber 24', a shielding plate 25', and a retainer 28', are the same as their counterparts in the male shielding connector A.

Having the above structure, the male shielding connector A is assembled in the following manner.

Figure 5A:
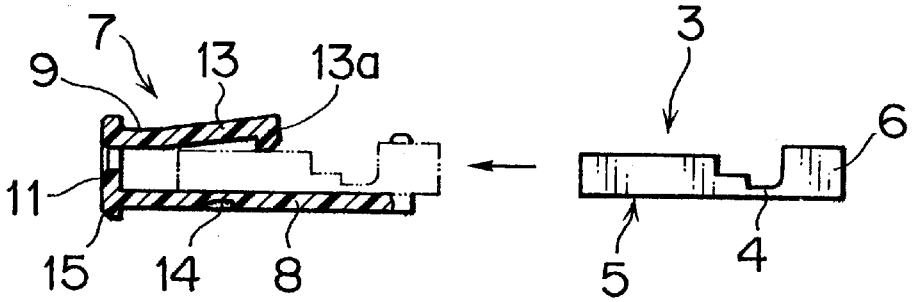
FIGS. 5A to 5C are illustrations of an assembling process of the shielding terminal.

Firstly, as shown in FIG. 5A, the electrical contact 5 of the inner terminal 3 is inserted into the contact holding cylinder 9 of the insulating holding member 7. Upon insertion, the locking arm 13 of the contact holding cylinder 9 bends upward as shown in the figure. When the tip of the electrical contact 5 reaches the stopper wall 11, the locking arm 13 elastically recovers so that the stopper protrusion 13*a* is engaged with the rear end of the electrical contact 5 to prevent the electrical contact 5 from slipping off backward.

As there is no need for special procedures and devices for positioning and securing as in the prior art, the inner terminal 3 can be easily attached to the insulating holding member 7.

Figure 5B:
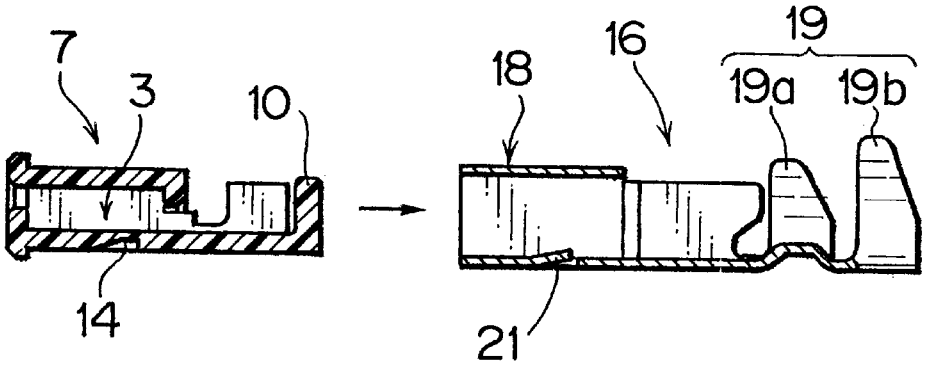
Figure 5C:
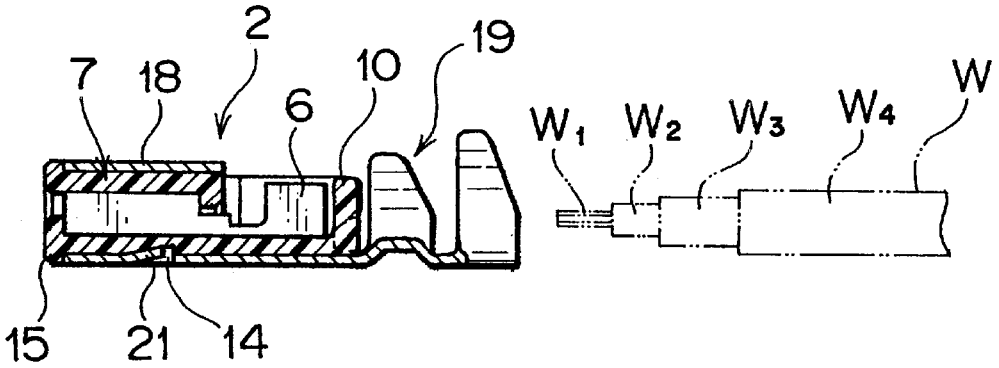
Figure 6:
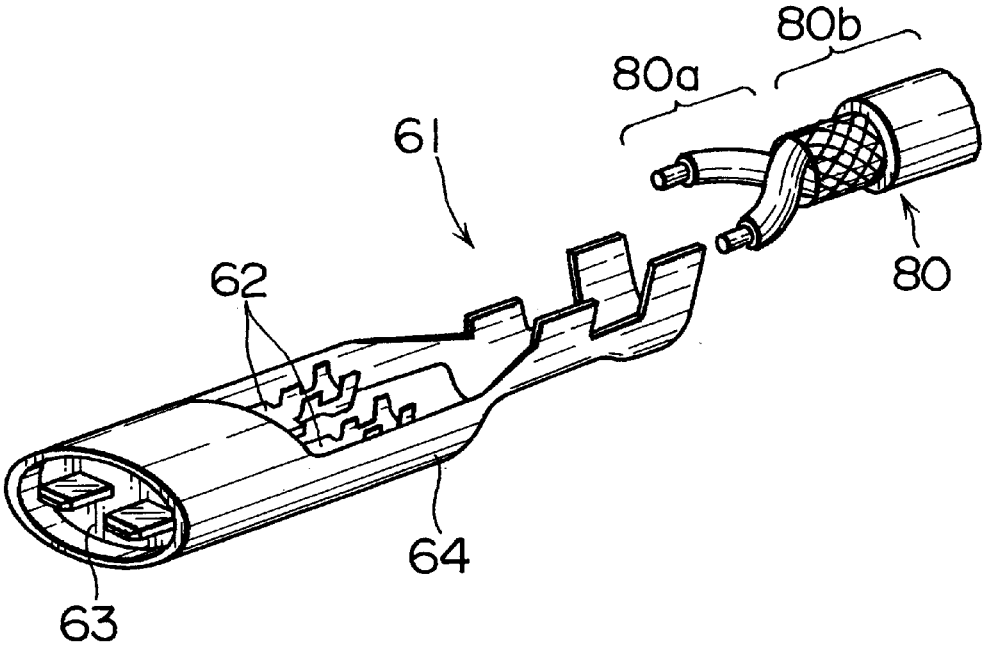
FIG. 6 PRIOR ART
FIG. 6 is a perspective view of a shielding terminal of the prior art.
Figure 7:
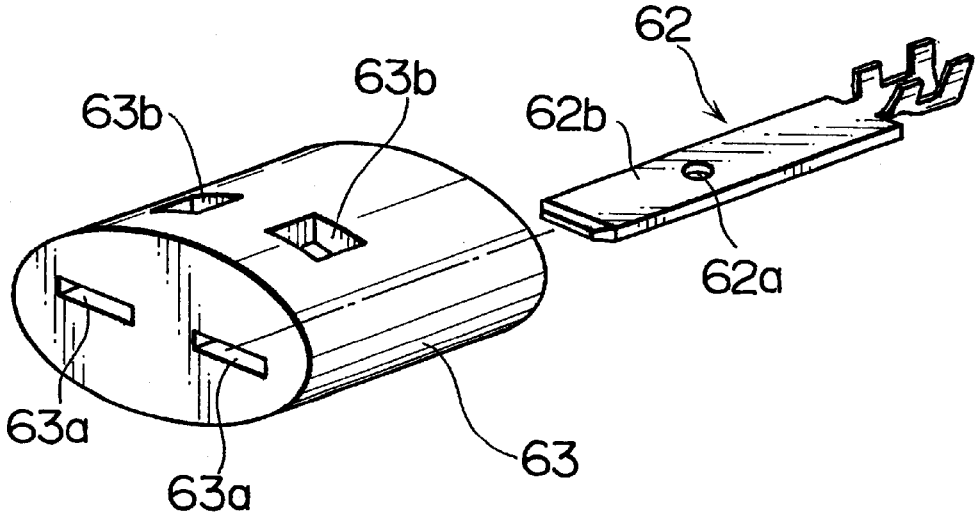
FIG. 7 PRIOR ART
FIG. 7 is an exploded view of a terminal holding member c and an inner terminal b of the shielding terminal of FIG. 6.
Figure 8A:
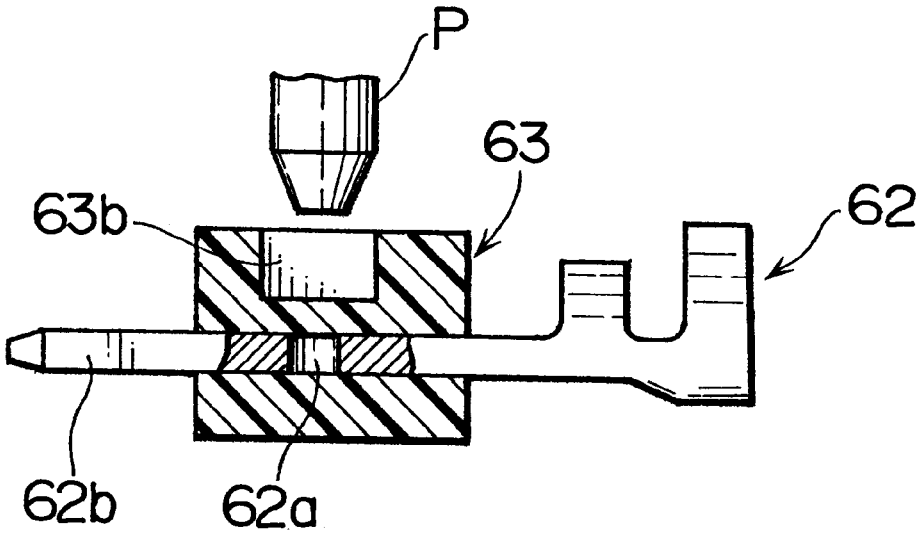
FIG. 8A PRIOR ART
FIG. 8A is an illustration of a conventional assembling process of the terminal holding member c.
Figure 8B:
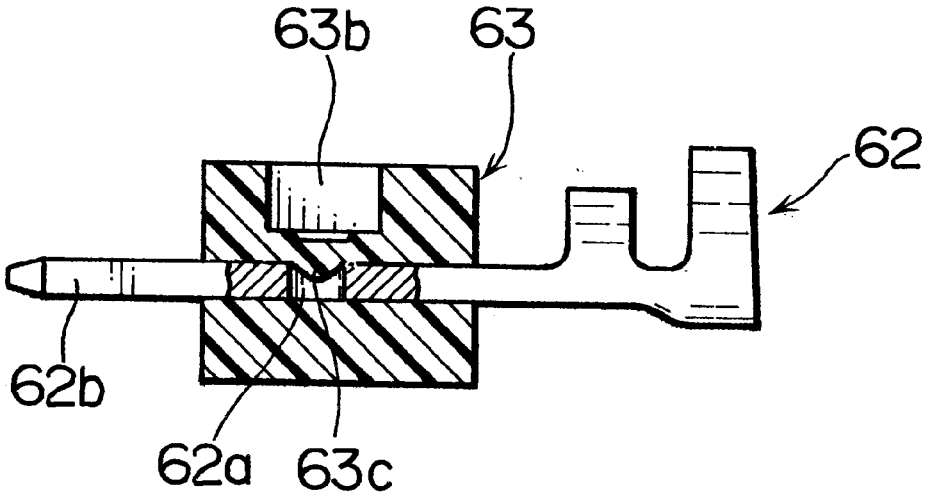
FIG. 8B PRIOR ART
FIG. 8B is an illustration of a conventional assembling process of the inner terminal b.
Figure 9A:
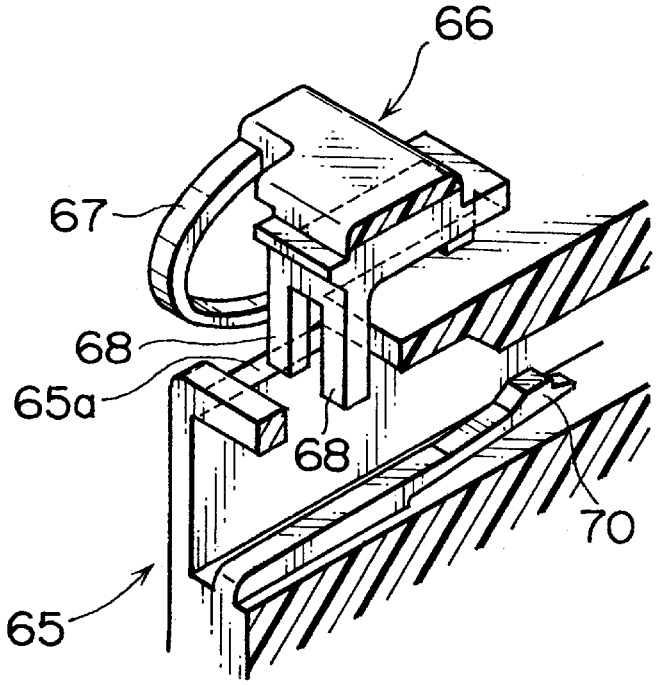
FIG. 9A PRIOR ART
FIG. 9A is a broken perspective view of a shielding connector having another shield structure of the prior art.
Figure 9B:
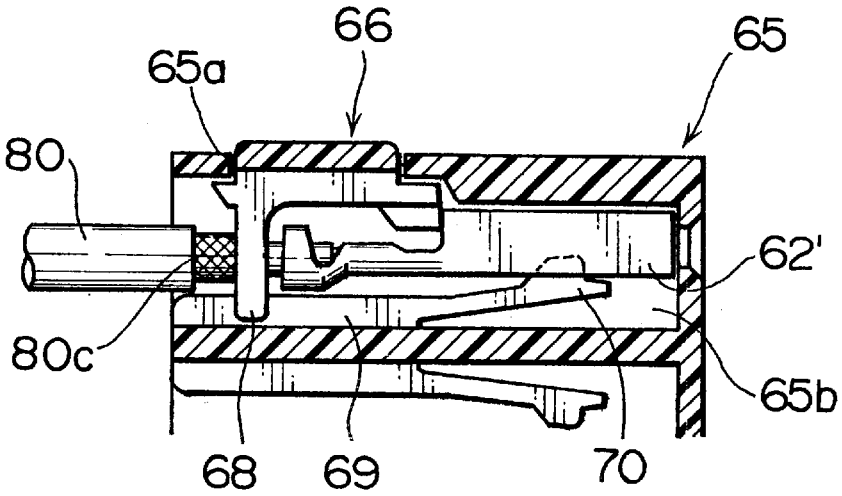
FIG. 9B PRIOR ART
FIG. 9B is a sectional view of a conventional assembling process of the shielding connector.

As shown in FIG. 5B, the insulating holding member 7 is inserted into the holding member receiving portion 18 at the front of the outer terminal 16, with the insulating separating ribs 10 facing toward the outer terminal 16. As shown in FIG. 5C, the flange 15 at the top end of the insulating holding member 7 is brought into contact with the holding member receiving portion 18, and the stopper protrusion 21 is engaged with the stopper concave portion 14.

Thus, the insulating holding member 7 is secured to the outer terminal 16 so that it cannot move forward or backward. The insulating separating ribs 10 of the insulating holding member 7 are situated halfway between the inner conductor connecting portion 6 of the inner terminal 3 and the outer conductor connecting portion 19 of the outer terminal 16, so that the inner conductor connecting portion 6 and the outer conductor connecting portion 19 can be separated from each other.

If the insertion of the insulating holding member 7 into the inner terminal 3 is incomplete, the rear edge of the locking arm 13 bends upward, as shown in FIG. 5A, and is blocked by the holding member receiving portion 18. In such case, the situation of the inner terminal 3 can be easily detected, and it can be corrected.

Thus, the insulating holding member 7 can be easily inserted into the out terminal 16, and upon the insertion, whether the inner terminal 3 have been inserted completely is checked.

As shown in FIG. 5C, with the insulating holding member 7 holding the inner terminal 3 being covered with and secured by the outer terminal 16, the shielded cable W is pressed and secured by using a pressing jig.

As indicated by the broken line in FIG. 5C, the shielded cable W is gradually peeled so as to expose the inner conductor $W_1$, the inner conductor coat $W_2$, and the outer conductor $W_3$. The inner conductor $W_1$ and the inner conductor coat $W_2$ are exposed by great lengths. The root of the exposed inner conductor coat $W_2$ is set between the inner conductor coat holding pieces 6*c* of the inner terminal 3. The mid section of the exposed inner conductor coat $W_2$ is bent in an S-shape and pushed into the inner conductor slack space 6*d*. The inner conductor $W_1$ at the top end is then bent and put between the pair of inner conductor holding pieces 6*b* and 6*b*'. Here, the outer conductor $W_3$ and the outer coat $W_4$ are set to the outer conductor holding piece 19*a* and the outer coat holding piece 19*b*, respectively.

In the above condition, the shielded cable W is simultaneously pressed and connected to the inner terminal 3 and the outer terminal 16 by driving the pressing jig, as shown in FIGS. 1 and 2.

The inner conductor $W_1$ is interposed between the back and front inner conductor holding pieces 6 *b* and 6*b*'. The inner conductor coat $W_2$ is pressed between the coat holding grooves $6c_1$ of the inner conductor coat holding pieces 6*c* with assistance of the S-shaped slack portion of the inner conductor coat $W_2$. The outer conductor $W_3$ and the outer coat $W_4$ are pressed and secured by the outer conductor holding piece 19*a* and the outer coat holding piece 19*b*, respectively.

Accordingly, even if the shielded cable W is subjected to a pull strength, the force acting on the inner conductor $W_1$ is reduced at the three attachment portions (19*a*, 19*b*, and 6*c*), and further softened at the S-shaped slack portion (6*d*), so that the inner conductor is not adversely influenced by the pull strength, and that the wrong contact with the inner terminal 3 can be prevented. Since the core connecting portion 6 of the inner terminal 3 is separated from the outer conductor connecting portion 19 of the outer terminal 16 by means of the insulating separating ribs 10 of the insulating holding member 7, the outer conductor $W_3$ is never brought into contact with the inner terminal 3.

As described above, when the shielding terminal 2 pressed and connected to the shielded cable W is inserted into the terminal receiving chamber 24 of the insulating housing 1, the front of the expanding portion 20 in the mid section of the outer terminal 16 is brought into contact with the protruding wall 24*a* in the center of the inner wall of the receiving chamber, and the stopper protrusion 27*a* of the flexible stopper arm 27 is engaged with the rear edge of the holding member receiving portion 18 so that the shielding terminal 2 is prevented from slipping off forward and backward.

When the retainer 28 is inserted through the rear opening edge of the terminal receiving chamber 24, and when the stopper groove 28*d* of the retainer 28 is engaged with the stopper protrusion 30 on the inner wall of the receiving chamber, the top edge of the terminal holding plate 28*c* is brought into contact with the rear edge of the outer conductor connecting portion 19 of the outer terminal 16, so that the shielding terminal 2 can be doubly prevented from slipping off backward.

In the male shielding connector A, the outer terminal 16 of the shielding terminal 2 in the insulating housing 1 is brought into contact with the shielding plate 25 also in the insulating housing 1. Thus, the inner terminal 3 is completely surrounded and shielded.

The assembling of the female shielding connector B is the same as of the male shielding connector A. The male shielding connector A and the female shielding connector B are connected to each other in the same manner as in connecting conventional male and female connectors. The stopper protrusion 32 is engaged with the stopper hole 26*a* of the locking arm 26, so that the connectors A and B are locked to each other, and the inner terminals 3 and 3', and the outer terminal 16 and 16' are also engaged, respectively.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A shielding connector, comprising:

an inner terminal including a conductive substrate, an electrical contact at a first end of the conductive substrate, and an inner conductor connecting portion at a second end of the conductive substrate, the inner terminal being connected to an inner conductor of a shielded cable;

an insulating holding member holding the inner terminal;

an outer terminal covering the insulating holding member and connected to the outer conductor of the shielded cable;

a shielding terminal made up of the inner terminal, the insulating holding member, and the outer terminal;

an insulating housing for accommodating the shielding terminal and having a shielding layer in contact with the outer terminal;

a contact holding cylinder for receiving the electrical contact of the inner terminal at a first end of an insulating support plate;

a locking arm to be engaged with the inner terminal in the contact holding cylinder so as to prevent the inner terminal from slipping off backward;

a holding member receiving portion for receiving and securing the contact holding cylinder of the insulating holding member at the first end of the conductive substrate; and an outer conductor connecting portion behind the inner conductor connecting portion of the insulating holding member at the second end of the conductive substrate, wherein the insulating holding member includes the contact holding cylinder and the locking arm, and the outer terminal includes the holding member receiving portion and the outer conductor connecting portion.

2. The shielding connector according to claim 1, wherein the inner conductor connecting portion of the inner terminal is made up of a pair of side walls standing from both sides of the second end of the conductive substrate, and a pair of inner conductor holding pieces formed by inwardly bending the front free edge of the pair of side walls on the side of the electrical contact, and a pair of inner conductor coat holding pieces formed by inwardly bending the rear free edge of the pair of side walls facing to each other, and an inner conductor slack space is formed between the inner conductor holding pieces and the inner conductor coat holding pieces.

3. The shielding connector according to claim 1, wherein the insulating holding member is provided with insulating separating ribs on both sides of a second end of the insulating support plate, and the inner conductor connecting portion of the inner terminal is separated from the outer conductor connecting portion of the outer terminal by means of the insulating separating ribs.

4. The shielding connector according to claim 1, wherein the insulating holding member includes a stopper concave portion on the bottom surface of the insulating support plate, the outer terminal is provided with a stopper protrusion on the upper surface of the conductive substrate, and the stopper concave portion is engaged with the stopper protrusion so as to secure the insulating holding member and the outer terminal.

5. The shielding connector according to claim 1, wherein the outer terminal is provided with an expanding portion having a width greater than the holding member receiving portion between the holding member receiving portion and the outer conductor connecting portion, the insulating housing is provided with a protruding wall inside the terminal receiving chamber, and the expanding portion is brought into contact with the protruding wall, so that the shielding terminal is positioned inside the terminal receiving chamber.

6. The shielding connector according to any of claims 1 to 5, wherein the insulating housing is provided with a retainer detachably mounted to the rear opening edge of a terminal receiving chamber which accommodates the shielding terminal, and the retainer prevents the shielding terminal from slipping off backward.

7. The shielding connector according to claim 6, wherein the insulating housing is provided with a flexible stopper arm inside the terminal receiving chamber for engaging the shielding terminal, the retainer and the flexible stopper arm doubly prevent the shielding terminal from slipping off backward.

* * * * *